US006648170B1

(12) United States Patent
Watson

(10) Patent No.: US 6,648,170 B1
(45) Date of Patent: Nov. 18, 2003

(54) METHOD FOR DEPLOYING TRAFFIC WARNING DEVICES AND APPARATUS THEREFOR

(76) Inventor: Ted J. Watson, 27834 Dexter Dr., Saugus, CA (US) 91350

( * ) Notice: Subject to any disclaimer, the term of this patent is extended or adjusted under 35 U.S.C. 154(b) by 98 days.

(21) Appl. No.: 10/059,711

(22) Filed: Jan. 29, 2002

Related U.S. Application Data

(63) Continuation-in-part of application No. 09/934,217, filed on Aug. 21, 2001.

(51) Int. Cl.[7] ..... B65G 59/00
(52) U.S. Cl. ..... 221/1; 116/63 P; 206/803
(58) Field of Search ..... 221/1, 92, 191, 221/282, 289, 297; 116/63 P, 63 R; 404/9, 15, 16, 94; 206/803

(56) References Cited

U.S. PATENT DOCUMENTS

| | | | | |
|---|---|---|---|---|
| 1,875,424 A | | 9/1932 | Darling, Jr. et al. | |
| 2,887,930 A | | 5/1959 | Zoffmann | |
| 2,932,813 A | | 4/1960 | Stinebaugh | |
| 3,934,542 A | | 1/1976 | May et al. | |
| 4,274,127 A | | 6/1981 | Beck et al. | |
| 4,552,089 A | * | 11/1985 | Mahoney | 116/63 P |
| 4,864,299 A | | 9/1989 | Kuhl | |
| 5,012,923 A | * | 5/1991 | Hayes | 206/443 |
| 5,105,757 A | | 4/1992 | Geschwender et al. | |
| 5,199,375 A | | 4/1993 | Johson | |
| 5,484,225 A | | 1/1996 | Warner | |

* cited by examiner

*Primary Examiner*—Kenneth W. Noland
(74) *Attorney, Agent, or Firm*—Ted Masters

(57) ABSTRACT

A method and apparatus for deploying traffic warning devices, includes loading a plurality of traffic warning devices into a container through a loading port. The traffic warning devices remain stored in the container until they are needed to warn approaching vehicular or pedestrian traffic of an obstruction in a road, such as an accident. At that time, an officer causes the traffic warning devices to be dispensed from the container's deployment port and deposited upon the surface of the road. In a preferred embodiment, the container is modular and includes a top section, at least one middle section, and a bottom section. The holding capacity of the container may be increased by adding additional middle sections.

27 Claims, 12 Drawing Sheets

METHOD FOR DEPLOYING TRAFFIC WARNING DEVICES AND APPARATUS THEREFOR

CROSS REFERENCE TO RELATED APPLICATION

The present application is a Continuation In Part of application Ser. No. 09/934,217, filed Aug. 21, 2001 the entirety of which is included herein by reference.

TECHNICAL FIELD

The present invention pertains generally to traffic warning devices which are temporarily set out on the surface of a road to warn approaching vehicular or pedestrian traffic of an obstruction, and more particularly to a method and apparatus for deploying the traffic warning devices.

BACKGROUND OF THE INVENTION

It is common practice for law enforcement officers to carry highway flares and or orange traffic cones in their police vehicles, typically sedans and motorcycles. The trunk of the sedan is used to store and transport both the flares and the cones, however the limited cargo space of motorcycle saddle bags can only accommodate the flares. Slow burning red pyrotechnic highway flares are recognized internationally as an established means for law enforcement officers to guide or direct motor vehicles, bicycles, pedestrians, and aircraft. However, these devices have numerous disadvantages. To wit: they have a limited shelf life; they are susceptible to moisture damage; they are highly flammable and therefore can cause accidental burns; they emit noxious fumes and smoke into the environment; they can ignite oil, gasoline, or even vegetation at the site of an accident; once lit, they are difficult to extinguish; they have a short life and can therefore burn out when they are still needed; and, they can be used by unlawful parties to start fires.

In view of the aforementioned disadvantages, other types of traffic warning devices have been developed. One of these comprises an elongated traffic warning device having reflectors, a bright light for night, and bright colors for day, which is placed on the surface of a road to warn approaching motorists of an anomalous traffic situation. The traffic warning devices are deployed in a manner similar to flares, however they avoid the numerous flare shortcomings. The present invention is directed toward the storage, transportation, and rapid deployment of this type of traffic warning device.

SUMMARY OF THE INVENTION

The present invention is directed to a method and apparatus for storing, transporting, and rapidly deploying traffic warning devices. A container is combined with a plurality of traffic warning device to comprise a traffic warning system, wherein the traffic warning devices may be rapidly deployed upon the surface of a road at the site of a traffic anomaly to warn vehicular and pedestrian traffic. Reflective material and a bright color are disposed upon the container to provide enhanced visibility and officer safety.

In accordance with a preferred embodiment of the invention, a method and apparatus for deploying traffic warning devices, includes loading a plurality of traffic warning devices into a container through a loading port. The traffic warning devices remain stored in the container until they are needed to warn approaching vehicular or pedestrian traffic of an obstruction in a road, such as an accident. At that time, an officer causes the traffic warning devices to be sequentially dispensed from the container's deployment port and deposited in spaced arrangement upon the surface of the road.

In accordance with an important aspect of the invention, the deployment port has a retaining mechanism which inhibits the exit of the traffic warning device.

In accordance with an important feature of the invention, the dispensing operation includes rapidly moving the container downward to overcome the retaining mechanism and extricating a traffic warning device through the deployment port.

In accordance with another important aspect of the invention, the container has a top section connected to a bottom section by one or more middle sections.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
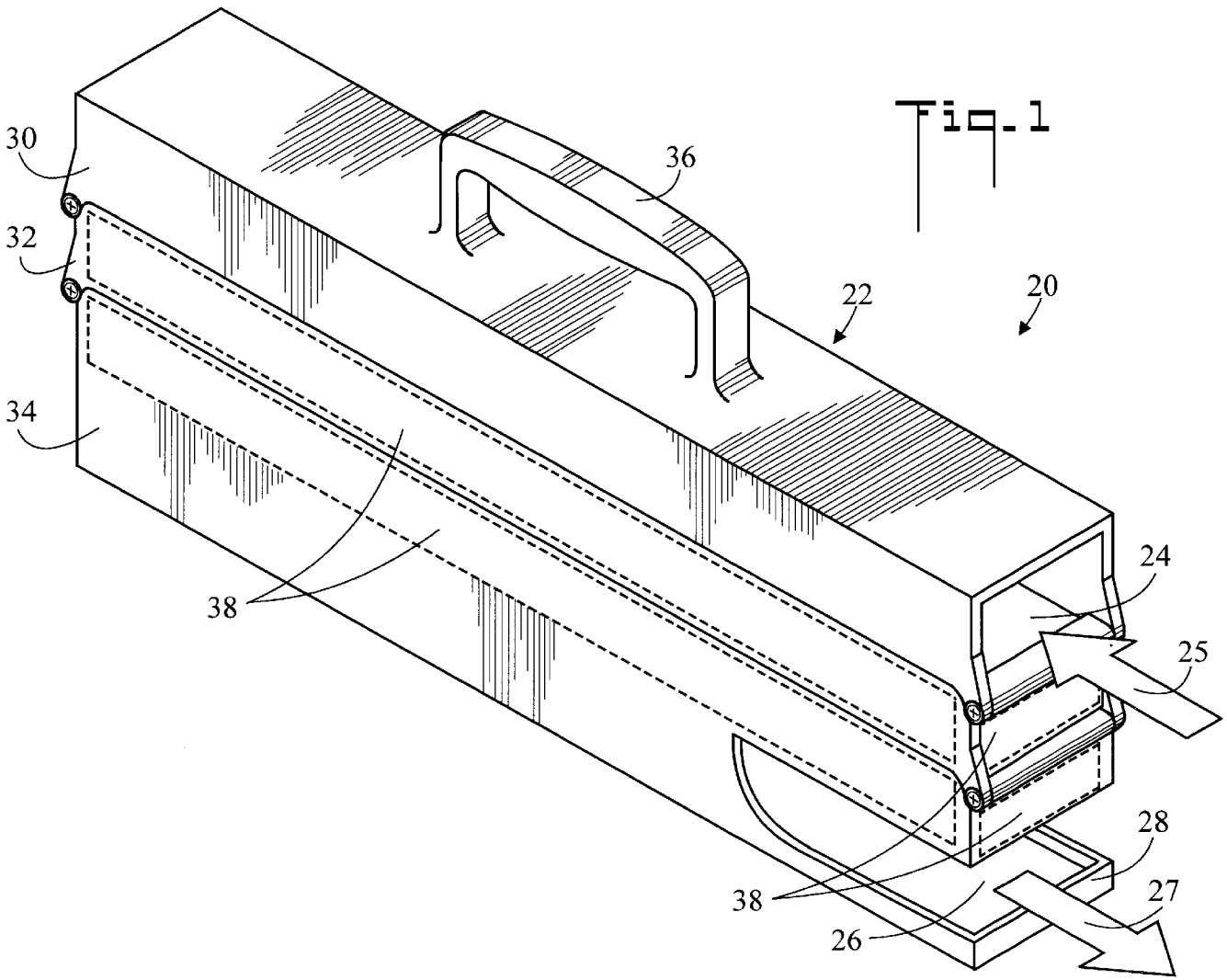
FIG. 1 is a perspective view of a container for storing, transporting, and deploying traffic warning devices in accordance with the present invention.
Figure 2:
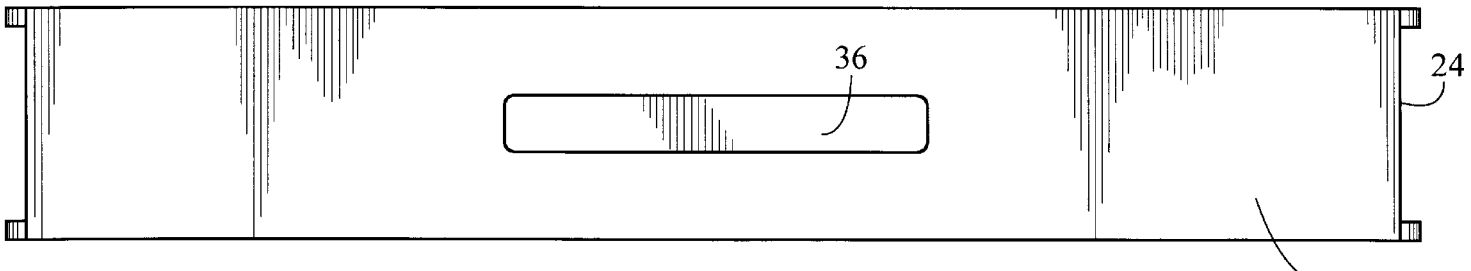
FIG. 2 is a top plan view of a top section of the container.
Figure 3:
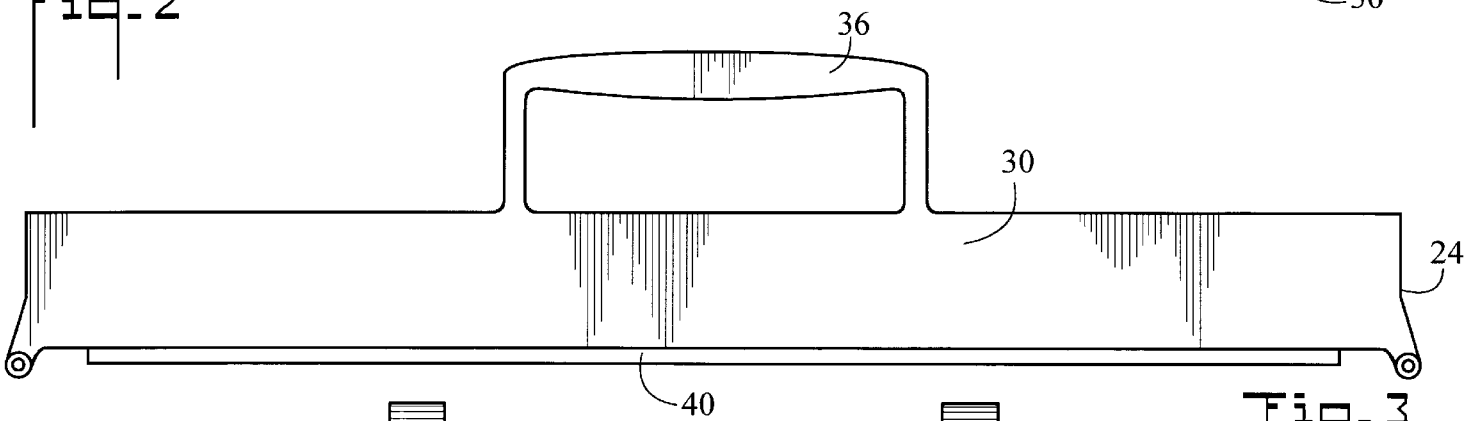
FIG. 3 is a side elevation view of the top section.
Figure 5:
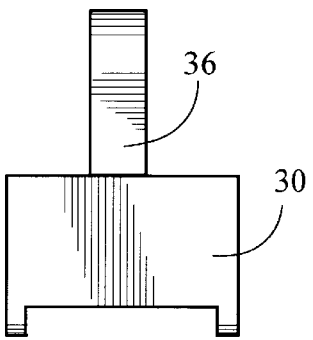
FIG. 5 is an opposite end elevation view of the top section.
Figure 4:
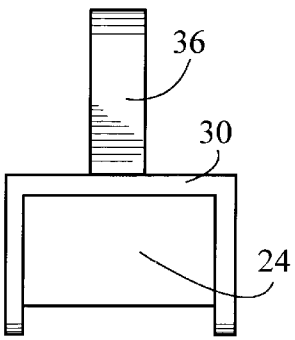
FIG. 4 is an end elevation view of the top section.
Figure 6:
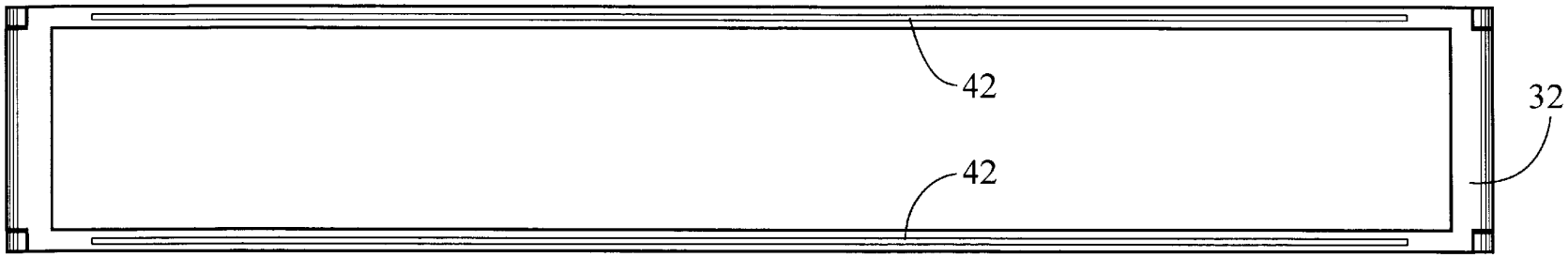
FIG. 6 is a top plan view of a middle section of the container.
Figure 7:
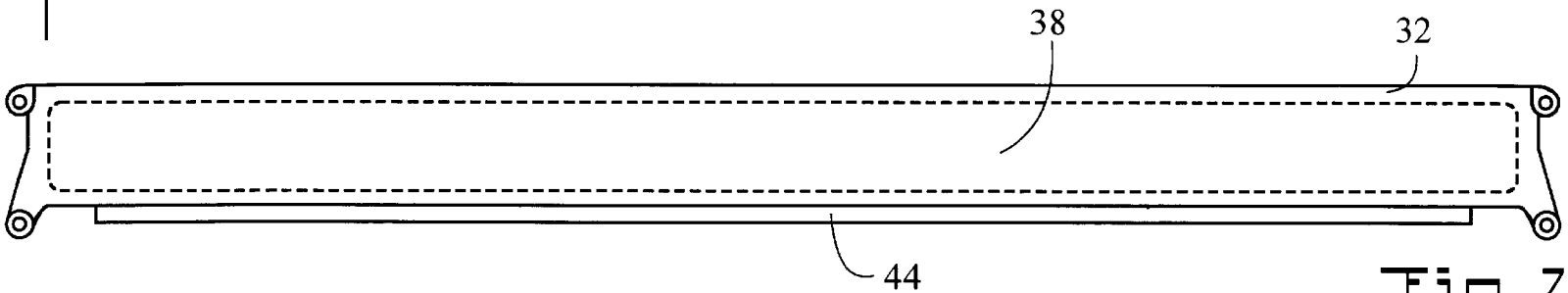
FIG. 7 is a side elevation view of the middle section.
Figure 9:
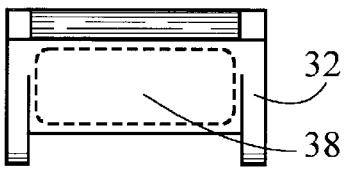
FIG. 9 is an opposite end elevation view of the middle section.
Figure 8:
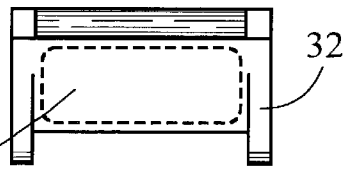
FIG. 8 is an end elevation view of the middle section.
Figure 10:
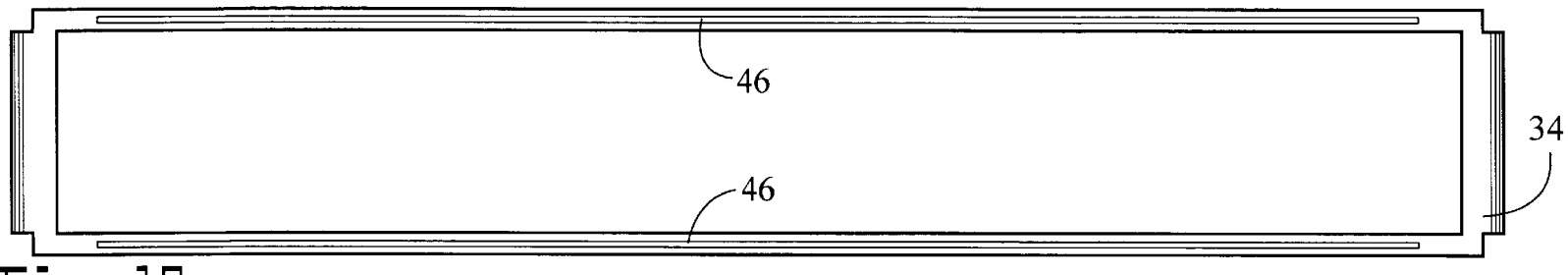
FIG. 10 is a top plan view of a bottom section of the container.
Figure 11:
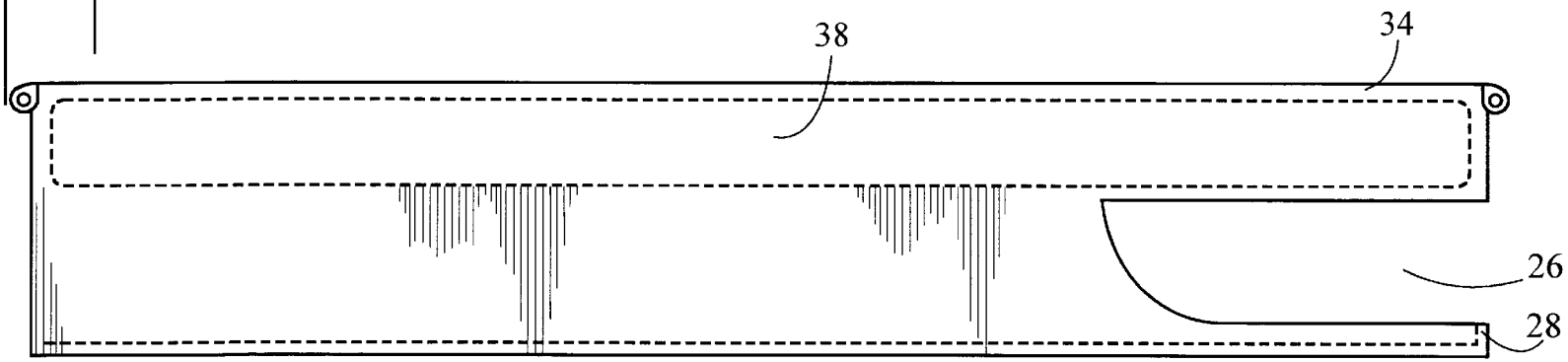
FIG. 11 is a side elevation view of the bottom section.
Figure 13:
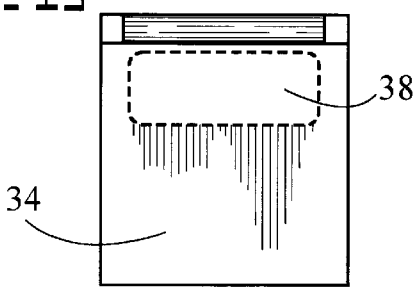
FIG. 13 is an opposite end elevation view of the bottom section.
Figure 12:
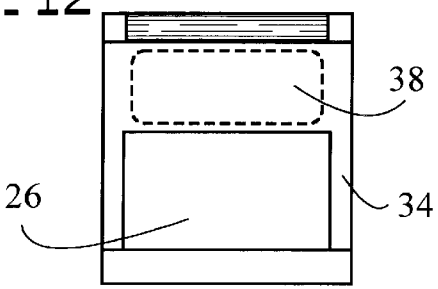
FIG. 12 is an end elevation view of the bottom section.

Referring initially to FIG. 1, there is illustrated a perspective view of a container for storing, transporting, and rapidly deploying a plurality of traffic warning devices (refer to FIGS. 16–18) in accordance with the present invention, generally designated as 20. Container 20 includes a hollow housing 22 having a loading port 24 and a deployment port 26, the loading port 24 and the deployment port 26 are each shaped and dimensioned to pass the traffic warning devices 60 (refer to FIGS. 16–18) so that the traffic warning devices 60 may enter container 20 through loading port 24 in direction 25, reside inside container 20 (such as for storage), and exit container 20 through deployment port 26 in direction 27. Deployment port 26 has a retaining mechanism 28 which holds traffic warning devices 60 in place within container 20, until such time as a user desires to dispense traffic warning devices 60 from container 20. In the shown preferred embodiment retaining mechanism 28 includes a lip over which traffic warning devices 60 must sequentially pass in order to exit container 20. However, it may be appreciated that other forms of retaining mechanism 28 could also be employed. Also, in the shown preferred embodiment, container 20 includes a top section 30, at least one middle section 32, and a bottom section 34, loading port 24 is disposed in top section 30 and deployment port 26 is disposed in bottom section 34. Top section 30, middle section 32, and bottom section 34 are modular and may be disconnected from each other (refer also to FIG. 14). A carrying handle 36 is disposed on top section 30. Housing 22 has an outer surface. To attract the attention of approaching night time motorists, a reflective material 38 is disposed upon the outer surface. Reflective material 38 will reflect the light from the headlights of a vehicle. For daytime use, a bright color, such as "international orange", is also disposed upon the outer surface.

FIGS. 2–5 are top plan, side elevation, end elevation, and opposite end elevation views respectively of top section 30 of container 20. Top section 30 comprises a hollow shell having an open loading port 24 disposed at one end. Elongated tenons 40 are used to connect top section 30 to middle section 32 (refer to FIGS. 6–9).

FIGS. 6–9 are top plan, side elevation, end elevation, and opposite end elevation views respectively of middle section 32 of container 20. Middle section 32 comprises a hollow frame. Elongated mortises 42 accept the elongated tenons 40 of top section 30. Elongated tenons 44 are used to connect middle section 32 to bottom section 34 (refer to FIGS. 10–13).

FIGS. 10–13 are top plan, side elevation, end elevation, and opposite end elevation views respectively of bottom section 34 of container 20. Bottom section 34 comprises a hollow shell having an open deployment port 26 disposed at one end. Elongated mortises 46 accept the elongated tenons 44 of middle section 32.

Figure 14:
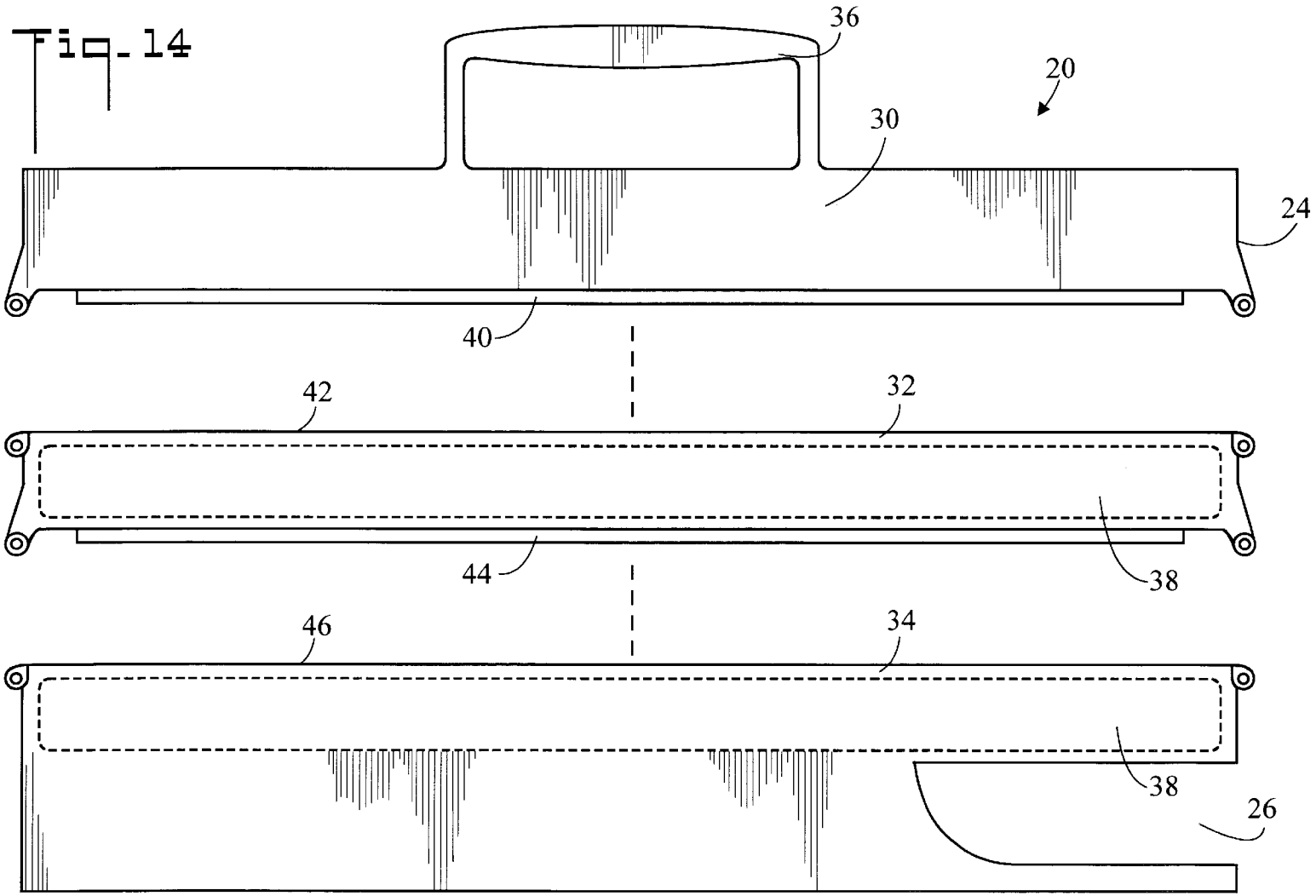
FIG. 14 is an exploded side elevation view of the container.

FIG. 14 is an exploded side elevation view of container 20 showing the disassembled relationship of top section 30, middle section 32, and bottom section 34. Tenon 40 is shaped and dimensioned to be received by mortise 42 (refer also to FIG. 6), and tenon 44 is shaped and dimension to be received by mortise 46 (refer also to FIG. 10).

Figure 15:
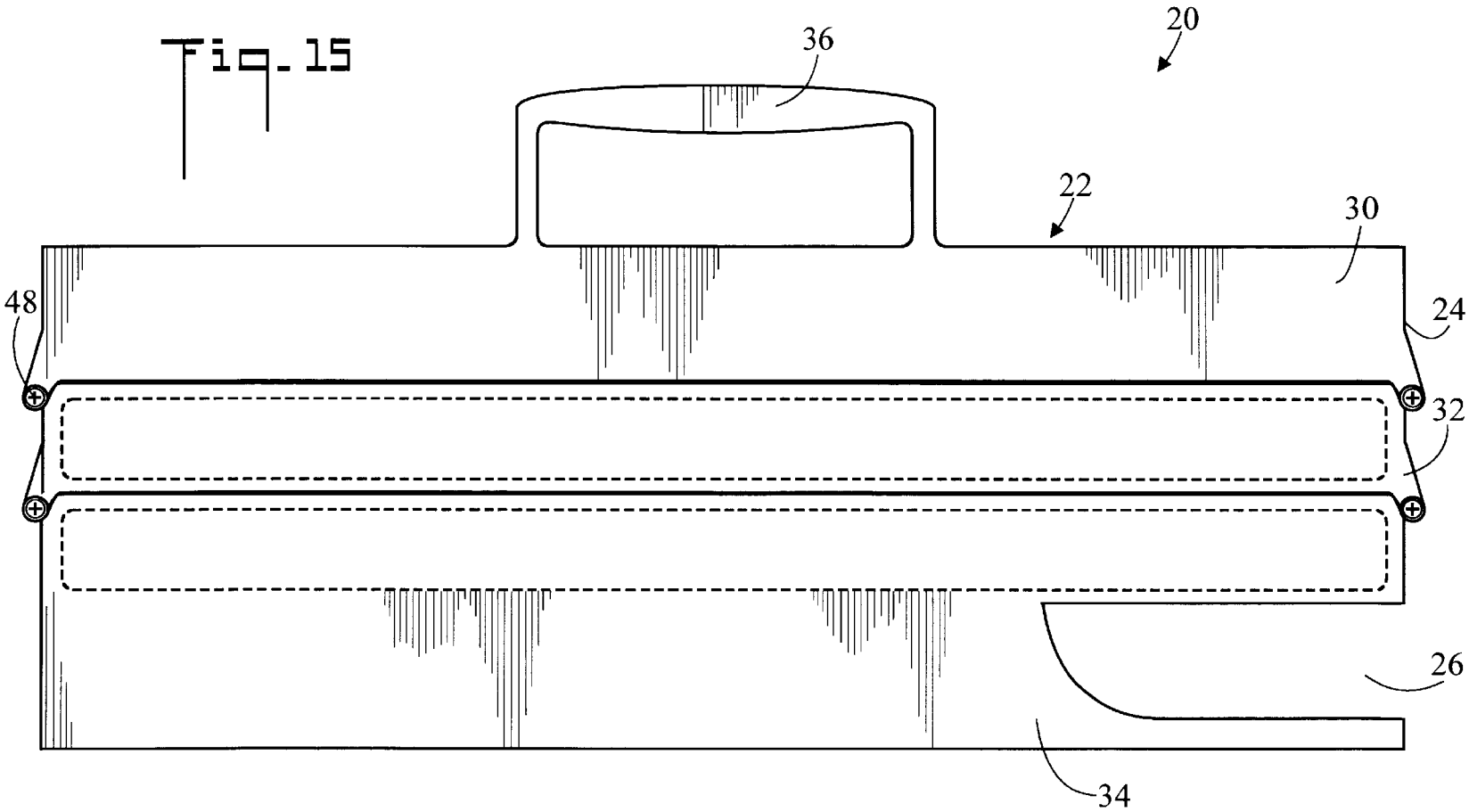
FIG. 15 is a side elevation view of the container.

FIG. 15 is a side elevation view of container 20 showing the assembled relationship of top section 30, middle section 32, and bottom section 34. Tenons 40 and 44 have been accepted by mortises 42 and 46 respectively, and screws 48 or other useful mechanical means are used to hold the sections together.

Figure 16:
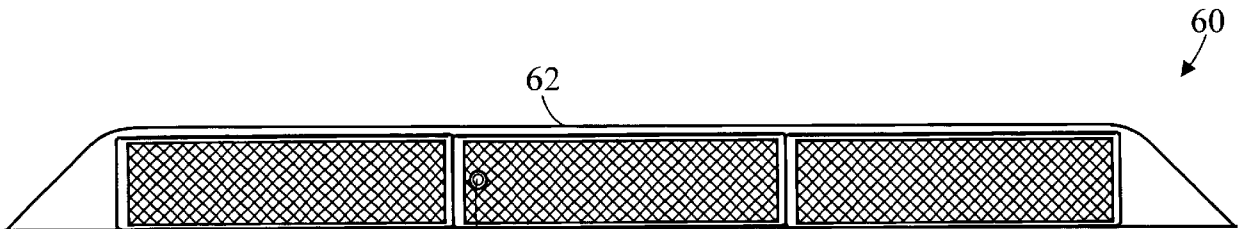
FIG. 16 is a side elevation view of a traffic warning device.
Figure 18:
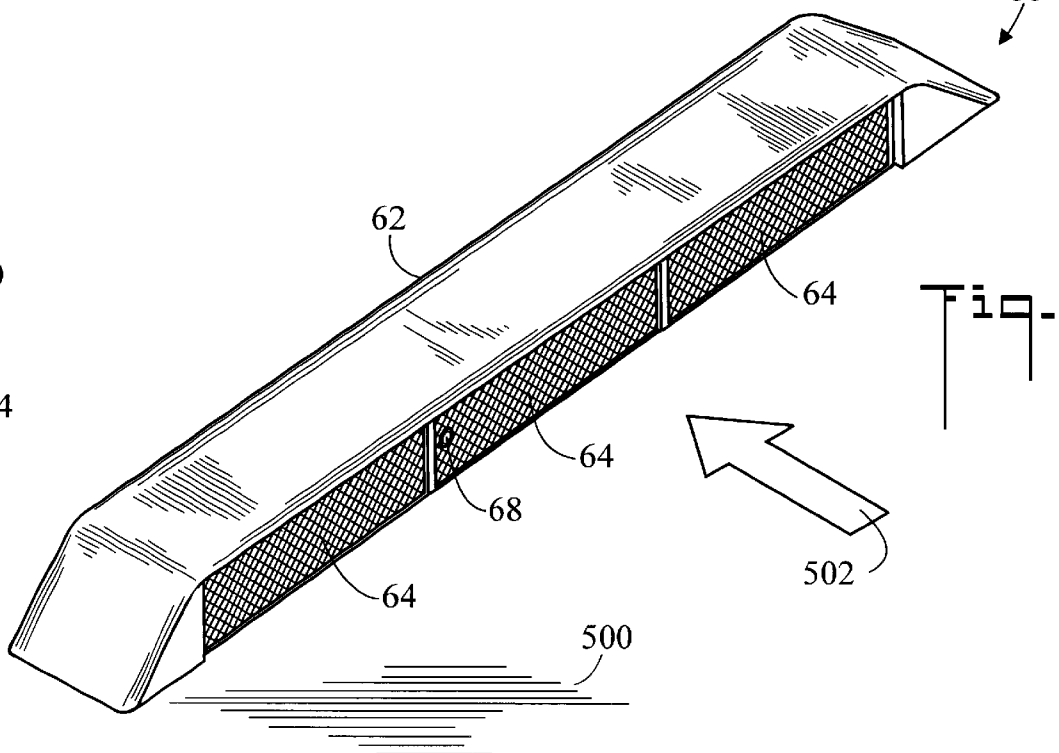
FIG. 18 is a perspective view of the traffic warning device.
Figure 17:
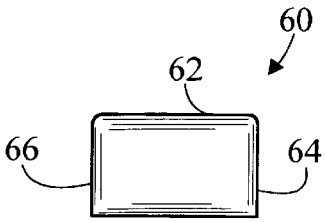
FIG. 17 is an end elevation view of the traffic warning device.

FIGS. 16–18 are side elevation, end elevation, and perspective views respectively of a traffic warning device in accordance with the present invention, generally designated as 60. Traffic warning device 60 has an elongated body 62 having an outer surface, a first side, and an opposite second side. A reflector 64 is disposed upon the outer surface of the first side, and a bright color 66, such as "international orange", is disposed upon the outer surface of the second side. Reflector 64 reflects the lights of an oncoming vehicle at night, and bright color 66 attracts the attention of motorists during the day. The first side also has a selectively activated light 68 which provides continuous illumination at night. In its deployed state, traffic warning device 60 is disposed upon the surface 500 of a road so that either reflector 64 and light 68 or bright color 66 generally face the direction of oncoming traffic 502 (depending upon whether it is night or day respectively).

Figure 19:
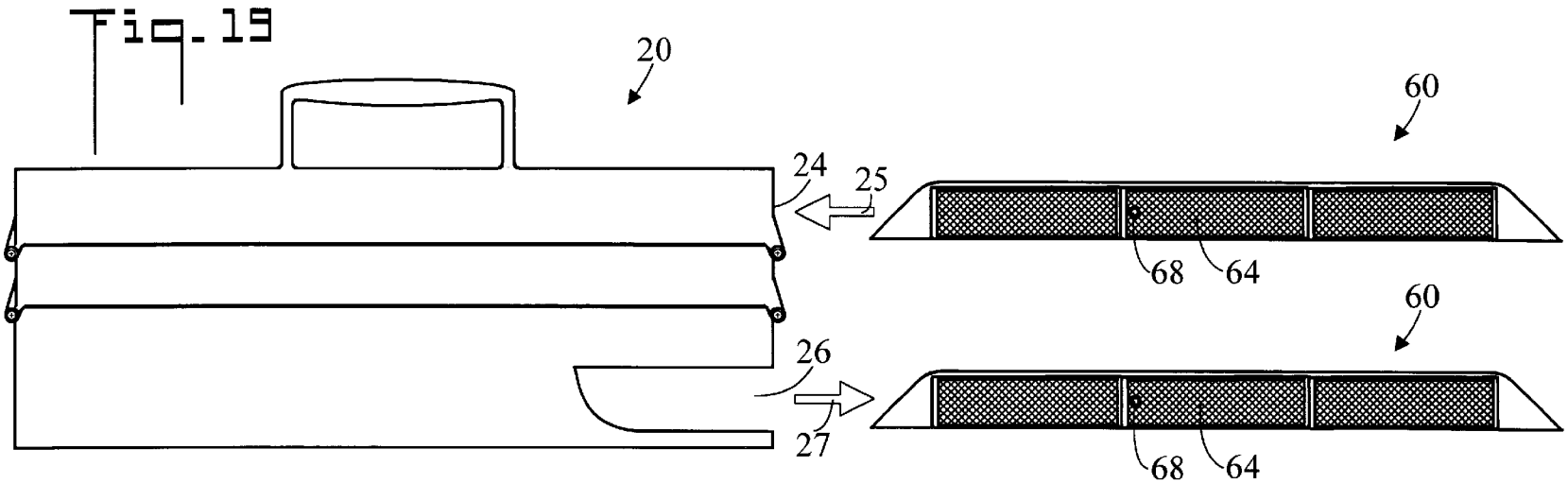
FIG. 19 is a reduced side elevation view of the container showing traffic warning devices being inserted into a loading port and dispensed from a deployment port.

FIG. 19 is a reduced side elevation view of container 20 showing traffic warning devices 60 being inserted into loading port 24 in direction 25, and dispensed from deployment port 26 in direction 27. In the shown preferred embodiment loading port 24 and deployment port 26 are configured so that traffic warning devices 60 are received and dispensed end first. It may be appreciated however, that the loading port 24 and deployment port 26 could also be arranged to receive and dispense traffic warning devices 60 in another manner. It is also noted that traffic warning devices 60 cooperate with container 20 on a first-in-first-out basis. That is, the first traffic warning device 60 which is loaded at loading port 24, will be the first traffic warning device 60 to be dispensed from deployment port 26.

Figure 20:
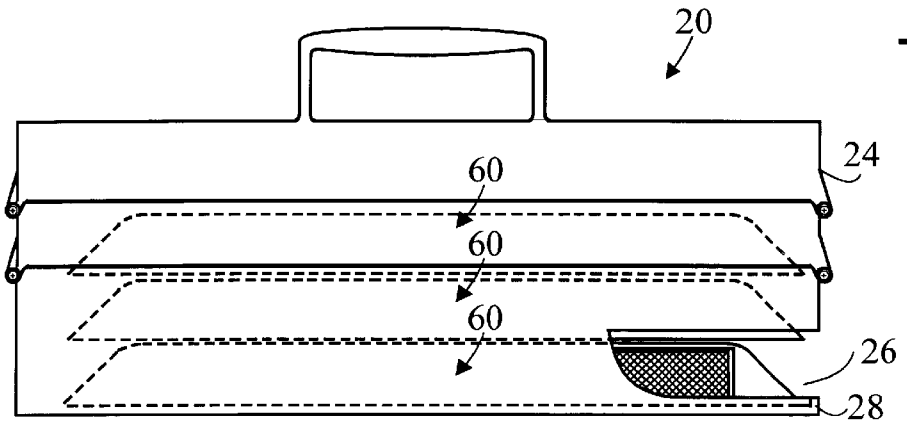
FIG. 20 is a reduced side elevation view of the container with a plurality of traffic warning devices installed in stacked relationship.

FIG. 20 is a reduced side elevation view of container 20 with a plurality of traffic warning devices 60 installed in stacked relationship. As traffic warning devices 60 are dispensed from deployment port 26, the stack of traffic warning devices 60 is incrementally diminished. Retaining mechanism 28 (lip) holds the bottom traffic warning device 60 in place within container 20.

Figure 21:
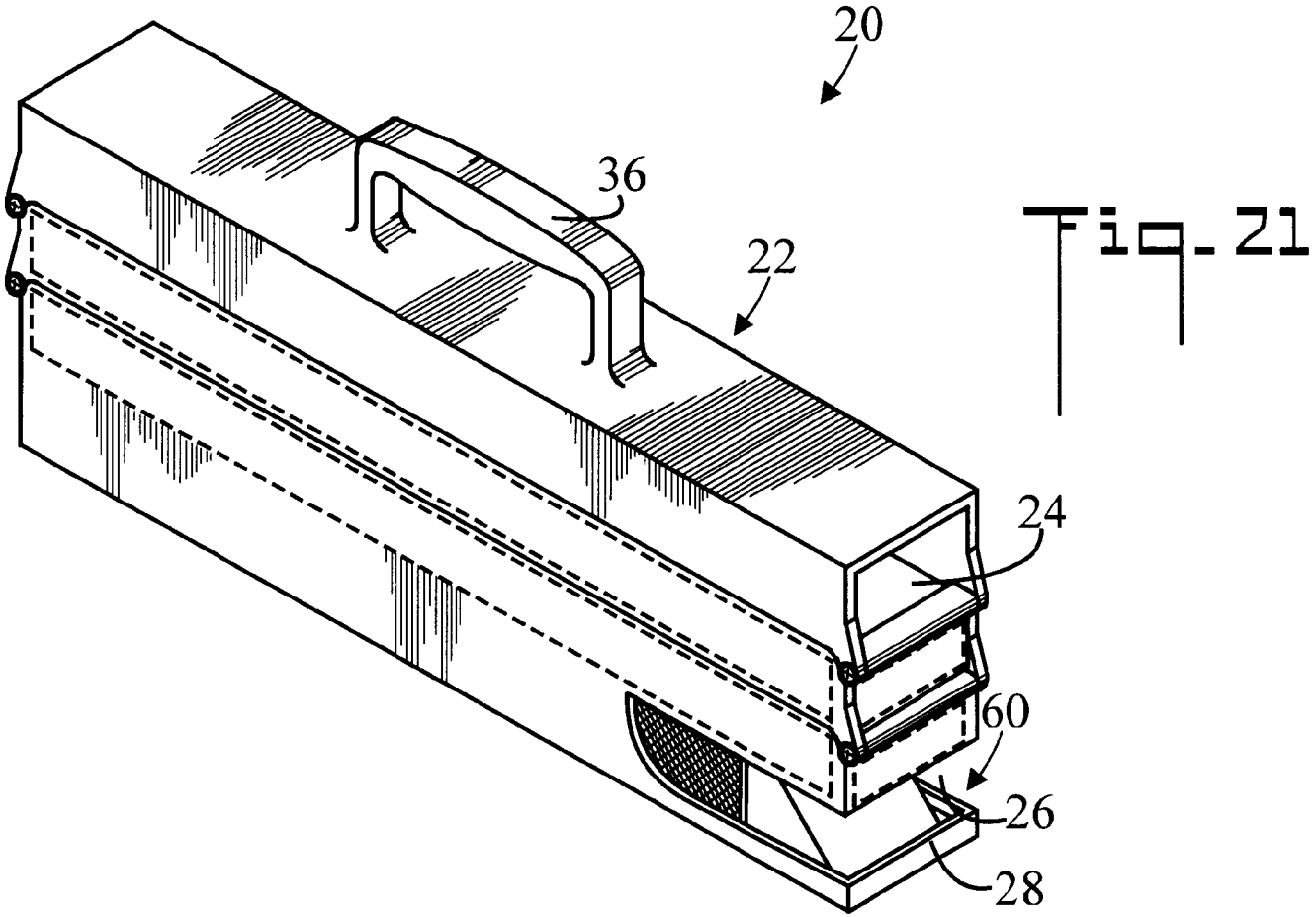
FIG. 21 is a reduced perspective view of the container with traffic warning devices installed.

FIG. 21 is a reduced perspective view of container 20 with traffic warning devices 60 installed.

Figure 22:
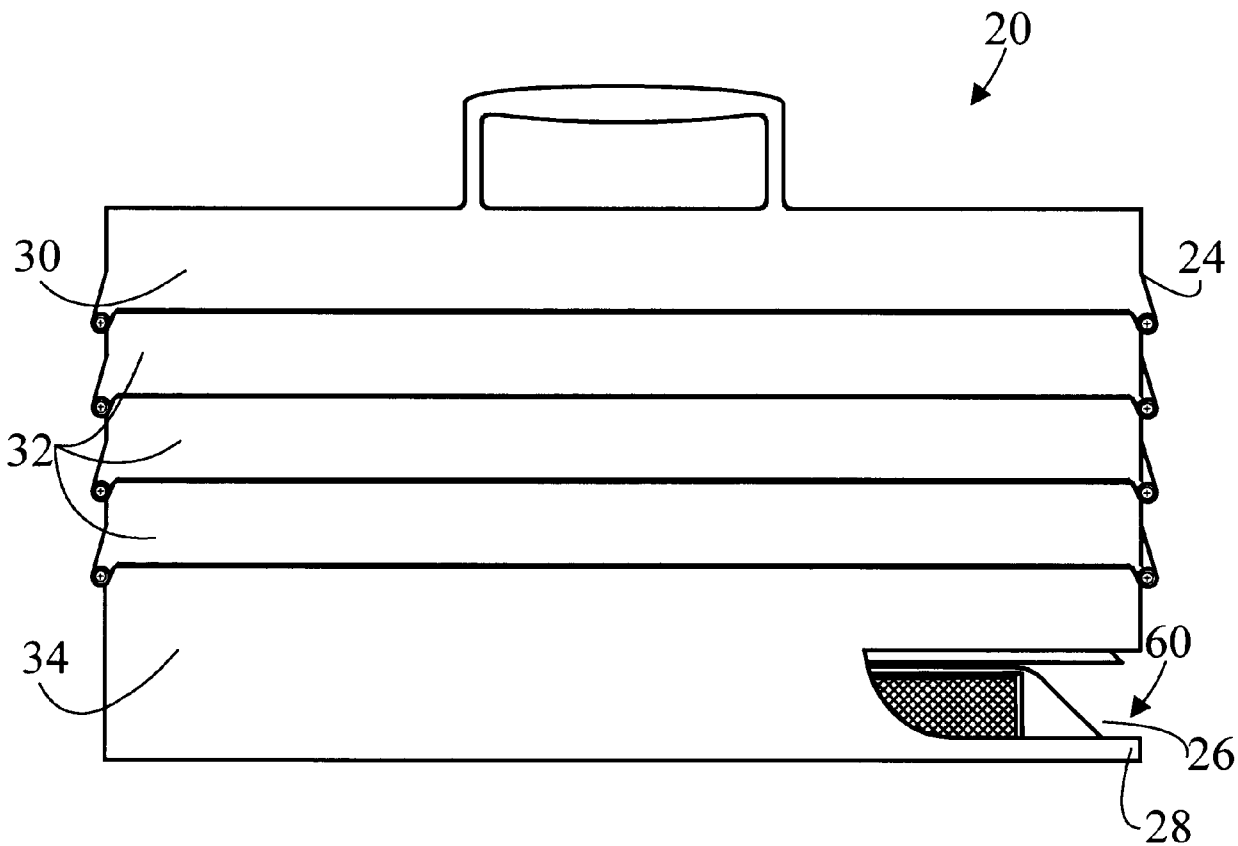
FIG. 22 is a reduced side elevation view of the container having a plurality of middle sections.

FIG. 22 is a reduced side elevation view of container 20 having a plurality of middle sections 32 disposed between top section 30 and bottom section 34. By increasing the number of middle sections 32, the storage capacity of container 20 may be correspondingly increased so that more traffic warning devices 60 may be stored and deployed without reloading.

Figure 23:
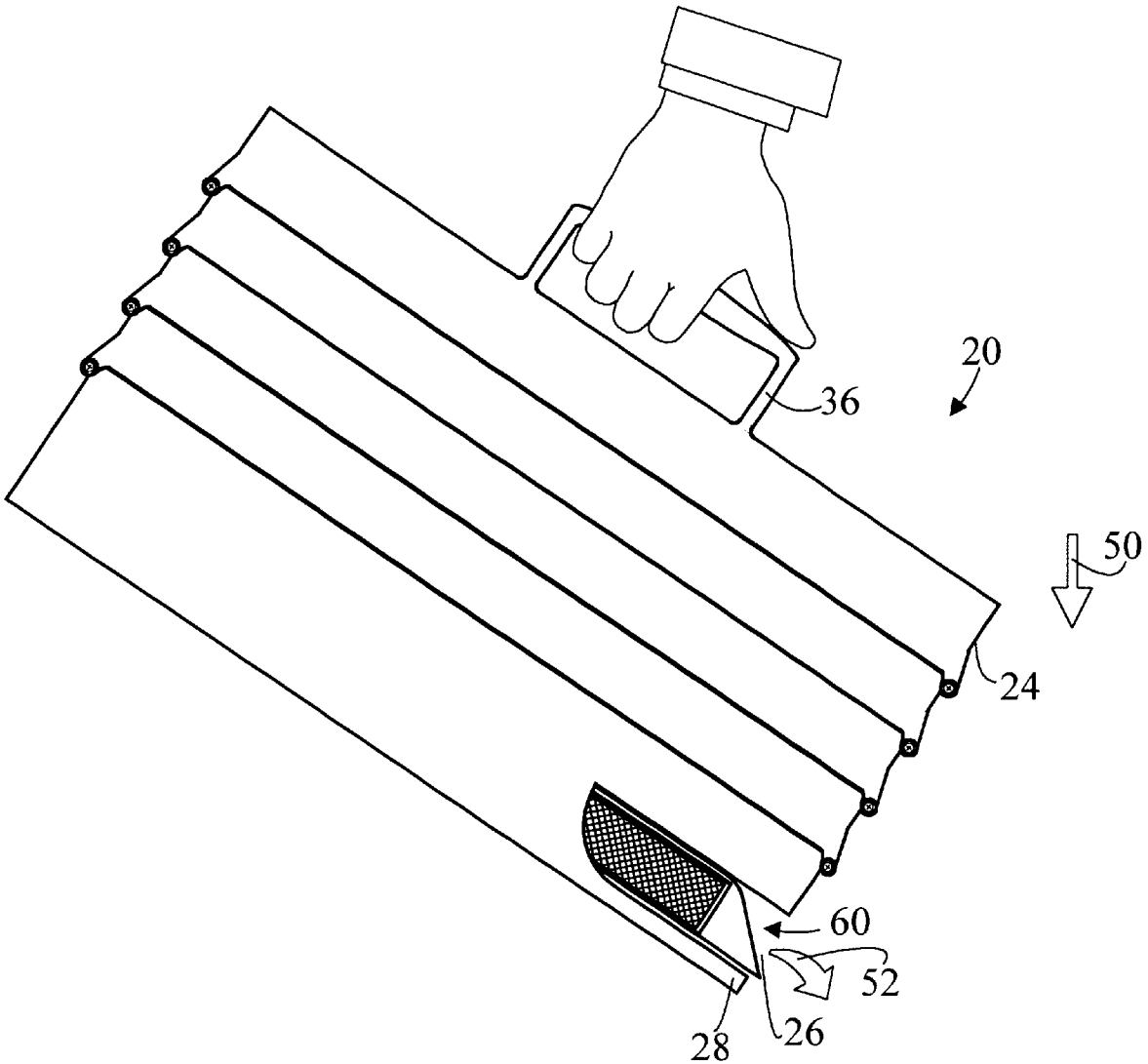
FIG. 23 is a reduced side elevation view of the container in a deployment position with a traffic warning device being dispensed from the deployment port; and, FIG. 24 is a reduced side elevation view of the container in a deployment position with the traffic warning device being deposited upon the surface of a road.

FIG. 23 is a reduced side elevation view of container 20 in a deployment position with a traffic warning device 60 being dispensed from deployment port 26. Container 20 is in a deployment orientation wherein loading port 24 is disposed above deployment port 26. In a preferred embodiment, traffic warning devices 60 are dispensed as follows:

grasping handle 36 and orienting container 20 such that loading port 24 is above deployment port 26;

pointing deployment port 26 slightly downward, and simultaneously moving container 20 downward in direction 50 so that said traffic warning devices 60 sequentially rise over lip 28 and are dispensed in direction 52. The inertia of the lowest traffic warning device 60 causes the device to rise above lip, and the downward orientation causes the device to fall out of deployment port 26.

Figure 24:
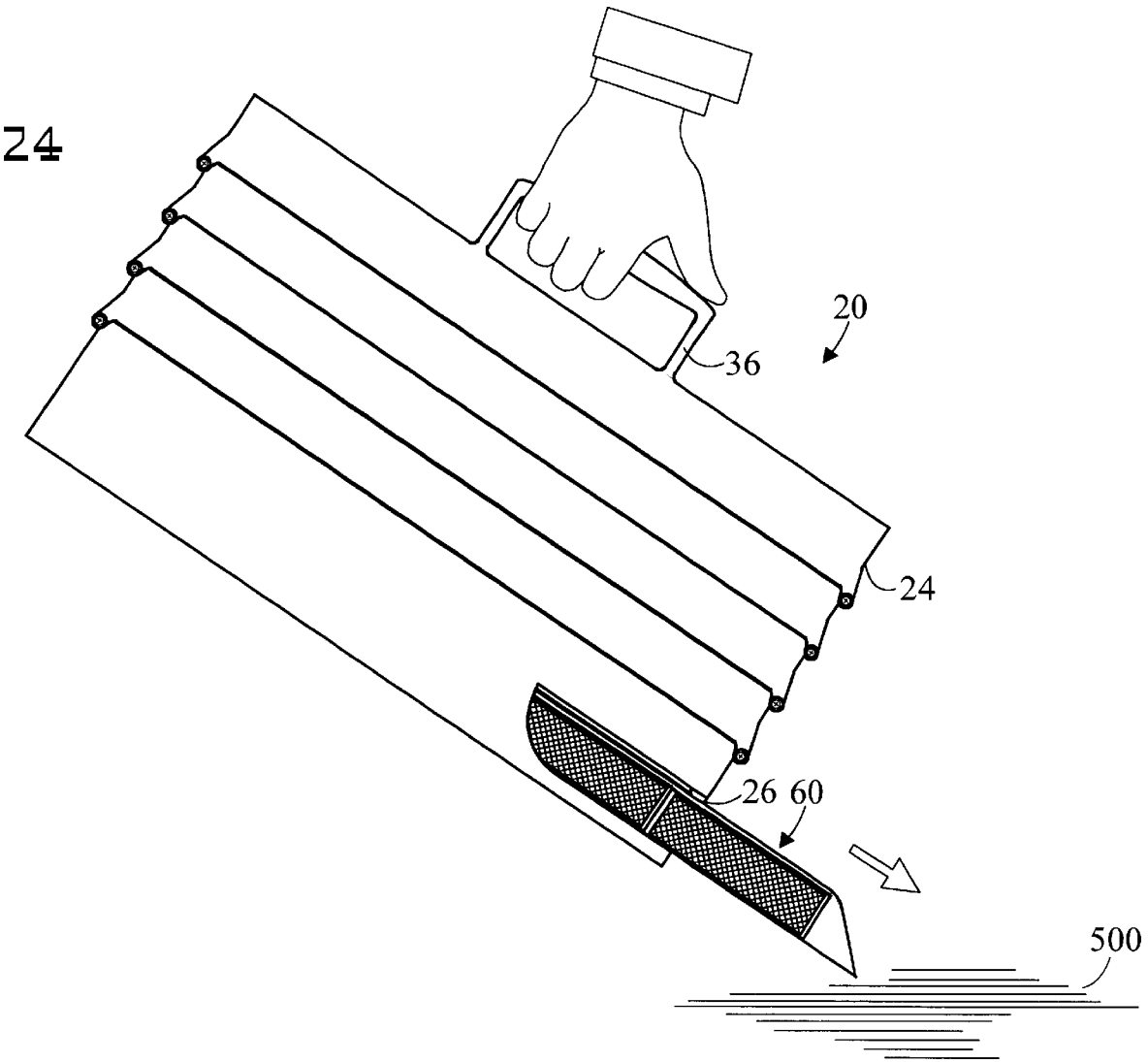

FIG. 24 is a reduced side elevation view of container 20 in a deployment position with the traffic warning device 60 being deposited upon the surface 500 of a road. FIG. 24 shows the position of traffic warning device 60 an instant after the position shown in FIG. 23.

It may be appreciated that container 20 and traffic warning device 60 combine to form a traffic warning system, wherein a plurality of traffic warning devices 60 can be stored, transported, rapidly deployed, and recovered.

In terms of use, a method for deploying traffic warning devices 60, includes:

(1) providing a plurality of traffic warning devices 60, each traffic warning device 60 having an elongated body 62;

(2) providing a road having a surface 500;

(3) providing a container 20 for deploying the traffic warning devices 60, the container including:

a housing 22 having a loading port 24 and a deployment port 26, the loading port 24 and the deployment port 26 each shaped and dimensioned to pass the traffic warning devices 60 so that the traffic warning devices 60 may enter the container 20 through the loading port 24, reside inside the container 20, and exit the container 20 through the deployment port 26; and, the deployment port 26 having a retaining mechanism 28 which holds the traffic warning devices 60 in place within container 20;

(4) inserting the plurality of traffic warning devices 60 into loading port 24 so that the traffic warning devices 60 reside inside container 20;

(5) transporting container 20 to a desired location; and, (6) causing the retaining mechanism 28 to sequentially release the traffic warning devices 60 so that the traffic warning devices 60 exit container 20 and are deposited upon the surface 500 of the road.

The method further including:

in step (1), the traffic warning devices having an outer surface, a first side, and an opposite second side, a reflector 64 and a light 68 are disposed upon the outer surface of the first side, and a bright color 66 such as "international orange" is disposed upon the outer surface of the second side;

in step (2), the road having a direction of oncoming traffic 502;

in step (3), the retaining mechanism 28 including a lip over which the traffic warning devices 60 must sequentially pass in order to exit container 20;

in step (3), container 20 having a handle 36; and, in step (6), grasping handle 36 and orienting container 20 such that loading port 24 is vertically above deployment port 26, pointing deployment port 26 slightly downward, and simultaneously moving container 20 downward so that traffic warning devices 60 sequentially rise over the lip and are deposited upon surface 500 of the road, so that either reflector 64 and light 68 or bright color 66 generally face the direction of oncoming traffic 502.

The method further including:

in step (3), container 20 including a top section 30, at least one middle section 32, and a bottom section 34, the loading port 24 disposed in top section 30 and the deployment port 26 disposed in bottom section 34.

The method further including:

container 20 having a plurality of middle sections 32 disposed between top section 30 and bottom section 34.

The method further including:

handle 36 disposed on top section 30.

The method further including:

in step (3), housing 22 having an outer surface; and, reflective material 38 disposed upon the outer surface.

The method further including:

in step (3), housing 22 having an outer surface; and, a bright color disposed upon said outer surface.

I claim:

1. A method for deploying traffic warning devices, comprising:

(1) providing a plurality of said traffic warning devices, each said traffic warning device having an elongated body;

(2) providing a road having a surface;

(3) providing a container for deploying said traffic warning devices, said container comprising:

a housing having a loading port and a deployment port, said loading port and said deployment port each shaped and dimensioned to pass said traffic warning devices so that said traffic warning devices may enter said container through said loading port, reside inside said container, and exit said container through said deployment port; and, said deployment port having a retaining mechanism which holds said traffic warning devices in place within said container;

(4) inserting said plurality of traffic warning devices into said loading port so that said traffic warning devices reside inside said container;

(5) transporting said container to a desired location; and, (6) causing said retaining mechanism to sequentially release said traffic warning devices so that said traffic warning devices exit said container and are deposited upon said surface of said road.

2. The method according to claim 1, further including:

in step (1), said traffic warning devices having an outer surface, a first side, and an opposite second side, a reflector disposed upon said outer surface of said first side, and a bright color disposed upon said outer surface of said second side;

in step (2), said road having a direction of oncoming traffic;

in step (3), said retaining mechanism including a lip over which said traffic warning devices must sequentially pass in order to exit said container;

in step (3), said container having a handle; and, in step (6), grasping said handle and orienting said container such that said loading port is above said deployment port, pointing said deployment port slightly downward, and simultaneously moving said container downward so that said traffic warning devices sequentially rise over said lip and are deposited upon said surface of said road, so that either said reflector or said bright color generally face said direction of oncoming traffic.

3. The method according to claim 1, further including:

in step (3), said container including a top section, at least one middle section, and a bottom section, said loading port disposed in said top section and said deployment port disposed in said bottom section.

4. The method according to claim 3, further including:

said container having a plurality of middle sections disposed between said top section and said bottom section.

5. The method according to claim 3, further including:

a handle disposed on said top section.

6. The method according to claim 1, further including:

in step (3), said housing having an outer surface; and, reflective material disposed upon said outer surface.

7. The method according to claim 1, further including:

in step (3), said housing having an outer surface; and, a bright color disposed upon said outer surface.

8. A container for deploying traffic warning devices, the traffic warning devices having an elongated body, said container comprising:

a housing having a loading port and a deployment port, said loading port and said deployment port each shaped and dimensioned to pass the traffic warning devices so that a plurality of the traffic warning devices may enter said container through said loading port, reside inside said container, and exit said container through said deployment port; and, said deployment port having a retaining mechanism which holds the traffic warning devices in place within said container.

9. A container according to claim 8, further including:

said container having a deployment orientation wherein said loading port is disposed above said deployment port.

10. A container according to claim 8, further including:

said container including a top section, at least one middle section, and a bottom section, said loading port disposed in said top section and said deployment port disposed in said bottom section.

11. A container according to claim 10, further including:

said container having a plurality of middle sections disposed between said top section and said bottom section.

12. A container according to claim 10, further including:

a handle disposed upon said top section.

13. A container according to claim 8, further including:

said housing having an outer surface; and, reflective material disposed upon said outer surface.

14. A container according to claim 8, further including;

said housing having an outer surface; and, a bright color disposed upon said outer surface.

15. A container according to claim 8, further including:

said retaining mechanism including a lip over which the traffic warning devices must pass in order to exit said container.

16. A container according to claim 8, further including:

said container having a deployment orientation wherein said loading port is disposed substantially above said deployment port;

said container including a top section, at least one middle section, and a bottom section, said loading port disposed in said top section and said deployment port disposed in said bottom section;

a handle disposed on said top section;

said container having an outer surface, wherein both reflective material and a bright color are disposed upon said outer surface; and, said retaining mechanism including a lip over which the traffic warning devices must pass in order to exit said container.

17. A traffic warning system comprising:

a plurality of traffic warning devices each said traffic warning device having an elongated body;

a container for deploying said plurality of traffic warning devices, said container including:

a housing having a loading port and a deployment port, said loading port and said deployment port each shaped and dimensioned to pass said traffic warning devices so that said traffic warning device may enter said container through said loading port, reside inside said container, and exit said container through said deployment port; and, said deployment port having a retaining mechanism which holds said traffic warning devices in place within said container.

18. A traffic warning system according to claim 17, further including:

said container having a deployment orientation wherein said loading port is disposed above said deployment port.

19. A traffic warning system according to claim 17, further including:

said container including a top section, at least one middle section, and a bottom section, said loading port disposed in said top section and said deployment port disposed in said bottom section.

20. A traffic warning system according to claim 19, further including:

said container having a plurality of middle sections disposed between said top section and said bottom section.

21. A traffic warning system according to claim 19, further including:

a handle disposed on said top section.

22. A traffic warning system according to claim 17, further including:

said housing having an outer surface; and, reflective material disposed upon said outer surface.

23. A traffic warning system according to claim 17, further including;

said housing having an outer surface; and, a bright color disposed upon said outer surface.

24. A traffic warning system according to claim 17, further including:

said retaining mechanism including a lip over which said traffic warning devices must pass in order to exit said container.

25. A traffic warning system according to claim 17, further including:

a bright color disposed upon said body of said traffic warning device.

26. A traffic warning system according to claim 17, further including:

said traffic warning devices having an outer surface, a first side, and an opposite second side, a reflector disposed upon said outer surface of said first side, and a bright color disposed upon said outer surface of said second side.

27. A traffic warning system according to claim 17, further including:

said container having a deployment orientation wherein said loading port is disposed substantially above said deployment port;

said container including a top section, at least one middle section, and a bottom section, said loading port disposed in said top section and said deployment port disposed in said bottom section;

a handle disposed on said top section;

said container having an outer surface, wherein both reflective material and a bright color are disposed upon said outer surface;

said retaining mechanism including a lip over which said traffic warning devices must pass in order to exit said container; and, said traffic warning devices having an outer surface, a first side, and an opposite second side, a reflector disposed upon said outer surface of said first side, and a bright color disposed upon said outer surface of said second side.

* * * * *